US011239544B2

(12) United States Patent
Wu et al.

(10) Patent No.: US 11,239,544 B2
(45) Date of Patent: Feb. 1, 2022

(54) BASE STATION ANTENNA AND MULTIBAND BASE STATION ANTENNA

(71) Applicant: CommScope Technologies LLC, Hickory, NC (US)

(72) Inventors: Ligang Wu, Suzhou (CN); Lei Yang, Suzhou (CN); Hangsheng Wen, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/081,373

(22) Filed: Oct. 27, 2020

(65) Prior Publication Data

US 2021/0135343 A1 May 6, 2021

(30) Foreign Application Priority Data

Oct. 31, 2019 (CN) ..... 201911056960.9
Dec. 25, 2019 (CN) ..... 201911351453.8

(51) Int. Cl.

| | |
|---|---|
| ***H01Q 21/26*** | (2006.01) |
| ***H01Q 1/24*** | (2006.01) |
| ***H01Q 5/307*** | (2015.01) |
| ***H01Q 21/06*** | (2006.01) |
| *H01Q 5/321* | (2015.01) |

(52) U.S. Cl.

CPC ..... *H01Q 1/246* (2013.01); *H01Q 5/307* (2015.01); *H01Q 21/062* (2013.01); *H01Q 21/26* (2013.01); *H01Q 5/321* (2015.01)

(58) Field of Classification Search

CPC ..... H01Q 1/246; H01Q 5/307; H01Q 21/062; H01Q 21/26; H01Q 5/321; H01Q 9/16

See application file for complete search history.

(56) References Cited

U.S. PATENT DOCUMENTS

| | | | | |
|---|---|---|---|---|
| 9,077,070 | B2 | 7/2015 | Zimmerman et al. | |
| 2015/0214617 | A1* | 7/2015 | Shang | H01Q 1/52 343/722 |
| 2018/0367199 | A1* | 12/2018 | Zimmerman | H01Q 25/001 |

* cited by examiner

*Primary Examiner* — Joseph J Lauture
(74) *Attorney, Agent, or Firm* — Myers Bigel, P.A.

(57) ABSTRACT

A base station antenna that extends along a first longitudinal axis includes a first array configured to emit electromagnetic radiation. The first array includes a first column of radiating elements, the first column including a first radiating element and a pair of second radiating elements. The first radiating element is a cross dipole radiating element and the pair of second radiating elements includes a pair of second radiating elements that are disposed facing each other on both sides of the first longitudinal axis, where each of the second radiating elements includes first and second radiating arms that extend respectively in opposite directions substantially along the first longitudinal axis, and a third radiating arm that extends toward the first longitudinal axis substantially perpendicular to the first and second radiating arms.

20 Claims, 8 Drawing Sheets

BASE STATION ANTENNA AND MULTIBAND BASE STATION ANTENNA

CROSS-REFERENCE TO RELATED APPLICATION

The present application claims priority to Chinese Patent Application No. 201911351453.8, filed Dec. 25, 2019, and to Chinese Patent Application No. 201911056960.9, filed Oct. 31, 2019, the entire content of each of which is incorporated herein by reference as if set forth fully herein.

FIELD

The present invention relates to the field of communications, and more particularly, to base station antennas and multiband base station antennas.

BACKGROUND

Each cell in a cellular communication system has one or more base station antennas that are configured to provide two-way wireless/radio frequency ("RF") communication to mobile users geographically located within the cell. Multiple base station antennas are typically used and each base station antenna is configured to provide service to a respective sector of the cell. In a cellular base station with a conventional three-sector configuration, the antenna in each sector is typically expected to have a beam width of approximately 65° (the "beam width" herein, unless otherwise specified, refers to half-power (−3 dB) beam width on the azimuth plane)

FIG. 9 is a schematic diagram of a conventional base station 60. The base station 60 includes a base station antenna 50 that may be mounted on raised structure 30. The raised structure 30 may be an antenna tower, but it will be appreciated that a wide variety of mounting locations may be used including, for example, utility poles, buildings, water towers and the like. The base station 60 also includes base station equipment, such as baseband units 40 and radios 42. A single baseband unit 40 and a single radio 42 are shown in FIG. 9 to simplify the drawing, but it will be appreciated that more than one baseband unit 40 and/or radio 42 may be provided. Additionally, while the radio 42 is shown as being co-located with the baseband unit 40 at the bottom of the raised structure 30, it will be appreciated that in other cases the radio 42 may be a remote radio head that is mounted on the raised structure 30 adjacent the antenna. The baseband unit 40 may receive data from another source such as, for example, a backhaul network (not shown) and may process this data and provide a data stream to the radio 42. The radio 42 may generate RF signals that include the data encoded therein and may amplify and deliver these RF signals to the base station antenna 50 for transmission via a cabling connection 44. It will also be appreciated that the base station 60 of FIG. 9 will typically include various other equipment (not shown) such as, for example, a power supply, backup batteries, a power bus, Antenna Interface Signal Group ("AISG") controllers and the like.

A tri-pole radiating element, as shown in FIG. 10A, is known in the prior art. The tri-pole radiating element 10 has three radiating arms (may be for example dipole arms): two side arms 11, 12 and a central arm 13. The length of each arm is about one quarter wavelength of the operating frequency band. The side arms 11, 12 are connected to central conductors of coaxial lines 16, 17 for feeding power, respectively. The central arm 13 is connected to outer conductors of the coaxial lines 16 and 17. The outer conductors of the coaxial lines 16 and 17 are connected to a reflector 20, which is spaced about one quarter-wavelength distance apart from the side arms 11, 12 and the central arm 13. In the example of FIG. 10A, the coaxial lines 16, 17 are used to feed the tri-pole radiating element. However, other types of feed lines (for example, microstrip transmission lines, stripline transmission lines, coplanar waveguide transmission lines) may also be used for feeding the tri-pole radiating element.

The tri-pole radiating element 10 may be considered as a combination of two dipole radiating elements, with each dipole radiating element being bent so that the included angle between two radiating arms thereof is approximately of 90 degrees. Referring to FIG. 10B, currents on each radiating arm and polarization vectors of radiation field (+45 and −45 slant polarizations) are shown. It is to be noted that the +45 degree slant and −45 degree slant are with respect to the side arms 11 and 12. Thus, the side arms 11 and 12 may be oriented horizontally or vertically with respect to the longitudinal axis of the reflector 20 to achieve ±45 degree polarization. This is in contrast to a cross dipole radiating element, where the radiation field of each dipole is at zero degree slant from the dipole arm, so that dipoles must be oriented at ±45 degrees from the longitudinal axis of the reflector 20 to achieve ±45 degree slant polarizations. Thus, the tri-pole radiating element with ±45 degree slant polarizations is physically smaller than a cross dipole radiating element with ±45 degree slant polarizations. For example, a width of the tri-pole radiating element (a dimension in a direction perpendicular to the longitudinal axis on the plane that is parallel to the reflector 20) may be about 0.25 wavelength (approximately the length of the central arm), while the width of the cross dipole radiating element is about 0.35 wavelength.

This feature of the tri-pole radiating element is friendly for multiband antenna applications. For efficient transmission and reception of RF signals, the dimensions of radiating elements are typically matched to a wavelength within the operating frequency band. For example, the tri-pole radiating element may be designed to operate in at least a portion of 617-960 MHz frequency band. The multiband antenna may further include a radiating element operating in a higher frequency band, for example, being designed to operate in at least a portion of 1695-2690 MHz frequency band. The radiating element with the higher operating frequency band extends forward from a reflector (e.g., a flat-plate reflector) less far forwardly than a radiating element with a lower frequency band. In an example of the multiband antenna, the radiating elements with different operating frequency bands are disposed adjacent to each other on the flat-plate reflector, which makes it possible for the radiating element with the lower operating frequency band to scatter radiation signals of the radiating element with the higher operating frequency band.

SUMMARY

A first aspect of this invention is to provide a base station antenna. The base station antenna may comprise a first array configured to emit electromagnetic radiation in a first frequency band so as to form a first antenna beam, the first array including a first column of radiating elements that are arranged substantially along a first longitudinal axis of the base station antenna, the first column including a first radiating element and a pair of second radiating elements, wherein: the first radiating element is a cross dipole radiating element; and the pair of second radiating elements includes a pair of second radiating elements that are disposed facing each other on both sides of the first longitudinal axis, wherein each of the second radiating elements includes first and second radiating arms that extend respectively in opposite directions substantially along the first longitudinal axis, and a third radiating arm that extends toward the first longitudinal axis substantially perpendicular to the first and second radiating arms.

A second aspect of this disclosure is to provide a multiband base station antenna. The multiband base station antenna may comprise a first array of radiating elements that are configured to operate in a lower first frequency band, the first array including a tri-pole radiating element, wherein the tri-pole radiating element includes first to third radiating arms that extend substantially parallel to a main surface of the base station antenna, and the radiating arms are each oriented such that a substantially right angle is formed either between extension directions of the first and second radiating arms or between extension directions of the second and third radiating arms; and a second array of radiating elements that are configured to operate in a higher second frequency band, the second array including a first radiating element, wherein at least one of the first to third radiating arms is configured to reduce a current that is excited in the at least one radiating arm in the second frequency band, and the at least one radiating arm extends substantially in a direction that is parallel to or perpendicular to a longitudinal axis of the base station antenna.

A third aspect of this disclosure is to provide a multiband base station antenna. The multiband base station antenna may comprise: a first array including a first radiating element that is configured to operate in a higher frequency band; a second array including a tri-pole radiating element that is configured to operate in a lower frequency band, the tri-pole radiating element including first to third radiating arms that extend substantially parallel to a main surface of the base station antenna, wherein the radiating arms are each oriented such that a substantially right angle is formed either between extension directions of the first and second radiating arms or between extension directions of the second and third radiating arms, and at least one of the first to third radiating arms extends substantially in a direction that is parallel to a longitudinal axis of the base station antenna; and a third array including a cross dipole radiating element that is configured to operate in the lower frequency band, wherein at least one dipole arm of the cross dipole radiating element is configured to reduce a current that is excited in the at least one dipole arm in the higher frequency band.

A fourth aspect of this invention is to provide a base station antenna. The base station antenna may comprise: a first radio frequency ("RF") port; a second RF port; and a first array of radiating elements that are configured to operate in a first frequency band, the first array including a first radiating element and a second radiating element, wherein the first radiating element is configured to have a lower impedance in the first frequency band than in a second frequency band, wherein at least part of frequencies in the second frequency band is higher than frequencies in the first frequency band; the second radiating element is configured to not have a lower impedance in the first frequency band than in the second frequency band; and each of the first and second radiating elements is coupled to both the first and second RF ports.

A fifth aspect of this invention is to provide a base station antenna. The base station antenna may comprise: a first radio frequency ("RF") port; a second RF port; a vertically-extending array of radiating elements, wherein each of the radiating elements in the array is coupled to the first RF port and to the second RF port, the array including at least one cross-dipole radiating element and at least one radiating element having either a vertically-extending dipole arm or a horizontally-extending dipole arm.

A sixth aspect of this invention is to provide a base station antenna. The base station antenna may comprise: a first radio frequency ("RF") port; a second RF port; a vertically-extending first array of radiating elements, wherein each of the radiating elements in the first array is coupled to the first RF port and to the second RF port, the first array including a first radiating element that includes a slant −45 degree dipole arm and a slant +45 degree dipole arm and a second radiating element that includes a vertical dipole arm and a horizontal dipole arm.

Other features of the present invention and advantages thereof will become explicit by means of the following detailed descriptions of exemplary embodiments of the present invention with reference to the drawings.

Figure 1A:
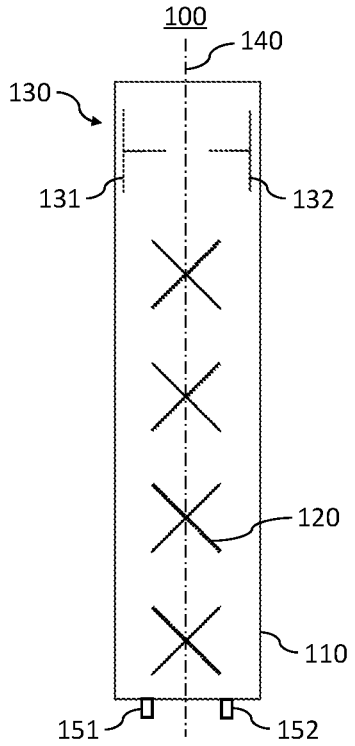
FIGS. 1A-1C are front views each schematically illustrating a configuration of a base station antenna according to an embodiment of the present invention.

Note that, in some cases the same elements or elements having similar functions are denoted by the same reference numerals in different drawings, and description of such elements is not repeated. In some cases, similar reference numerals and letters are used to refer to similar elements, and thus once an element is defined in one figure, it need not be further discussed for following figures.

In order to facilitate understanding, the position, size, range, or the like of each structure illustrated in the drawings may not be drawn to scale. Thus, the disclosure is not necessarily limited to the position, size, range, or the like as disclosed in the drawings.

DETAILED DESCRIPTION

The present invention will be described with reference to the accompanying drawings, which show a number of example embodiments thereof. It should be understood, however, that the present invention can be embodied in many different ways, and is not limited to the embodiments described below. Rather, the embodiments described below are intended to make the disclosure of the present invention more complete and fully convey the scope of the present invention to those skilled in the art. It should also be understood that the embodiments disclosed herein can be combined in any way to provide many additional embodiments.

The terminology used herein is for the purpose of describing particular embodiments, but is not intended to limit the scope of the present invention. All terms (including technical terms and scientific terms) used herein have meanings commonly understood by those skilled in the art unless otherwise defined. For the sake of brevity and/or clarity, well-known functions or structures may be not described in detail.

Herein, when an element is described as located "on" "attached" to, "connected" to, "coupled" to or "in contact with" another element, etc., the element can be directly located on, attached to, connected to, coupled to or in contact with the other element, or there may be one or more intervening elements present. In contrast, when an element is described as "directly" located "on", "directly attached" to, "directly connected" to, "directly coupled" to or "in direct contact with" another element, there are no intervening elements present. In the description, references that a first element is arranged "adjacent" a second element can mean that the first element has a part that overlaps the second element or a part that is located above or below the second element.

Herein, the foregoing description may refer to elements or nodes or features being "connected" or "coupled" together. As used herein, unless expressly stated otherwise, "connected" means that one element/node/feature is electrically, mechanically, logically or otherwise directly joined to (or directly communicates with) another element/node/feature. Likewise, unless expressly stated otherwise, "coupled" means that one element/node/feature may be mechanically, electrically, logically or otherwise joined to another element/node/feature in either a direct or indirect manner to permit interaction even though the two features may not be directly connected. That is, "coupled" is intended to encompass both direct and indirect joining of elements or other features, including connection with one or more intervening elements.

Herein, terms such as "upper", "lower", "left", "right", "front", "rear", "high", "low" may be used to describe the spatial relationship between different elements as they are shown in the drawings. It should be understood that in addition to orientations shown in the drawings, the above terms may also encompass different orientations of the device during use or operation. For example, when the device in the drawings is inverted, a first feature that was described as being "below" a second feature can be then described as being "above" the second feature. The device may be oriented otherwise (rotated 90 degrees or at other orientation), and the relative spatial relationship between the features will be correspondingly interpreted.

Herein, the term "A or B" used through the specification refers to "A and B" and "A or B" rather than meaning that A and B are exclusive, unless otherwise specified.

The term "exemplary", as used herein, means "serving as an example, instance, or illustration", rather than as a "model" that would be exactly duplicated. Any implementation described herein as exemplary is not necessarily to be construed as preferred or advantageous over other implementations. Furthermore, there is no intention to be bound by any expressed or implied theory presented in the detailed description.

Herein, the term "substantially", is intended to encompass any slight variations due to design or manufacturing imperfections, device or component tolerances, environmental effects and/or other factors. The term "substantially" also allows for variation from a perfect or ideal case due to parasitic effects, noise, and other practical considerations that may be present in an actual implementation.

Herein, certain terminology, such as the terms "first", "second" and the like, may also be used in the following description for the purpose of reference only, and thus are not intended to be limiting. For example, the terms "first", "second" and other such numerical terms referring to structures or elements do not imply a sequence or order unless clearly indicated by the context.

Further, it should be noted that, the terms "comprise", "include", "have" and any other variants, as used herein, specify the presence of stated features, steps, operations, elements, and/or components, but do not preclude the presence or addition of one or more other features, steps, operations, elements, components, and/or groups thereof.

Figure 1B:
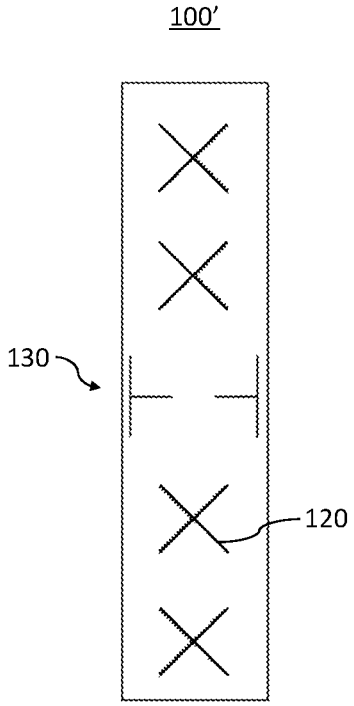
Figure 1C:
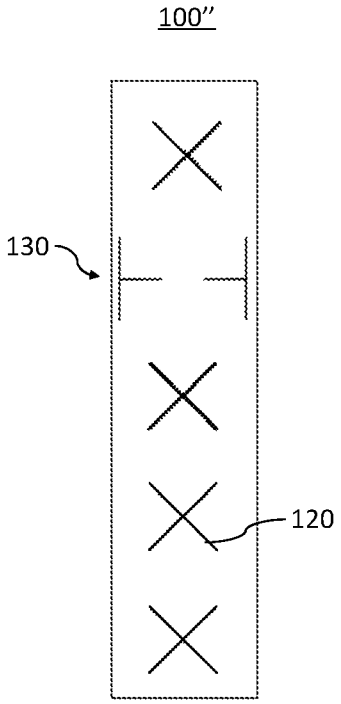

FIGS. 1A-1C are front views each schematically illustrating a configuration of a base station antenna 100 (or 100', 100") according to an embodiment of the present invention. As shown in FIG. 1A, the base station antenna 100 includes a linear array that includes a plurality of cross dipole radiating elements 120 arranged in a column substantially along a longitudinal axis 140 of the base station antenna, a pair of tri-pole radiating elements 130, and a reflector 110. The cross dipole radiating elements 120 and tri-pole radiating elements 131, 132 in the pair of tri-pole radiating elements 130 extend forwardly from the reflector 110.

Herein, the longitudinal axis 140 of the base station antenna may be a virtual axis (no physical structure needed as a shaft) that extends along a length direction (also referred to herein as a vertical direction) of the base station antenna 100. It should be noted that, for the sake of simplicity, the longitudinal axis is not shown in some drawings, but such virtual axes may exist in the antennas according to embodiments depicted by these drawings. Although the longitudinal axis 140 shown in FIG. 1A is located in the center of the base station antenna 100, it will be appreciated that the longitudinal axis referred to herein is not limited to the center axis. Although the cross dipole radiating elements 120 arranged in a column in the linear array are aligned with each other along the longitudinal axis 140 in the drawings, it will be appreciated that at least some of the cross dipole radiating elements 120 may be staggered to the left and right of the longitudinal axis 140 in a known manner in order to narrow the azimuth beamwidths of the antenna beams generated by the linear array. In addition, although the linear array includes a plurality of cross dipole radiating elements 120 in the drawings, it will be appreciated that the linear array may include only one cross dipole radiating element 120.

The pair of tri-pole radiating elements 130 includes a pair of tri-pole radiating elements 131 and 132 that are disposed facing each other on both sides of the longitudinal axis 140. Each tri-pole radiating element 131 and 132 may be constructed like the tri-pole radiating element shown in FIG. 9 or be a modification thereof. The two tri-pole radiating elements 131 and 132 are oriented such that two side arms of each tri-pole radiating element 131 and 132 extend upward and downward in directions that are substantially parallel to the longitudinal axis 140 respectively, and the center arm of one tri-pole radiating element extends toward the other tri-pole radiating element in a direction that is substantially perpendicular to the longitudinal axis 140. In an embodiment, the distance between phase centers of the two tri-pole radiating elements 131 and 132 in the pair of tri-pole radiating elements 130 may be 0.5 to 1 times the wavelength corresponding to the center frequency of the operating frequency band. Although the two tri-pole radiating elements 131 and 132 facing each other are aligned in the longitudinal direction, it will be appreciated that the two tri-pole radiating elements 131 and 132 may be staggered in the longitudinal direction.

The cross dipole radiating elements 120 are configured to operate in a first operating frequency band, and the tri-pole radiating elements 131, 132 are configured to operate in a second operating frequency band, wherein the first operating frequency band and the second operating frequency band at least partially overlap each other. In an embodiment, the first operating frequency band completely overlaps the second operating frequency band. For example, the cross dipole radiating elements 120 and the tri-pole radiating elements 131, 132 are each configured to operate in at least a portion of 617-960 MHz frequency band. An entire array consisting of the linear array of cross dipole radiating elements 120 and the pair of tri-pole radiating elements 130 may generate a combined antenna beam.

Figure 9:
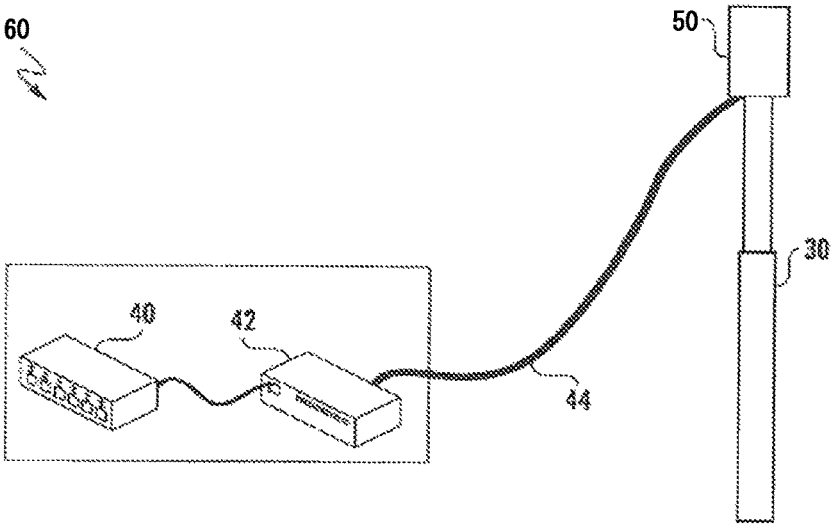
FIG. 9 is a simplified schematic view schematically illustrating a conventional base station in a cellular communication system.
Figure 10A:
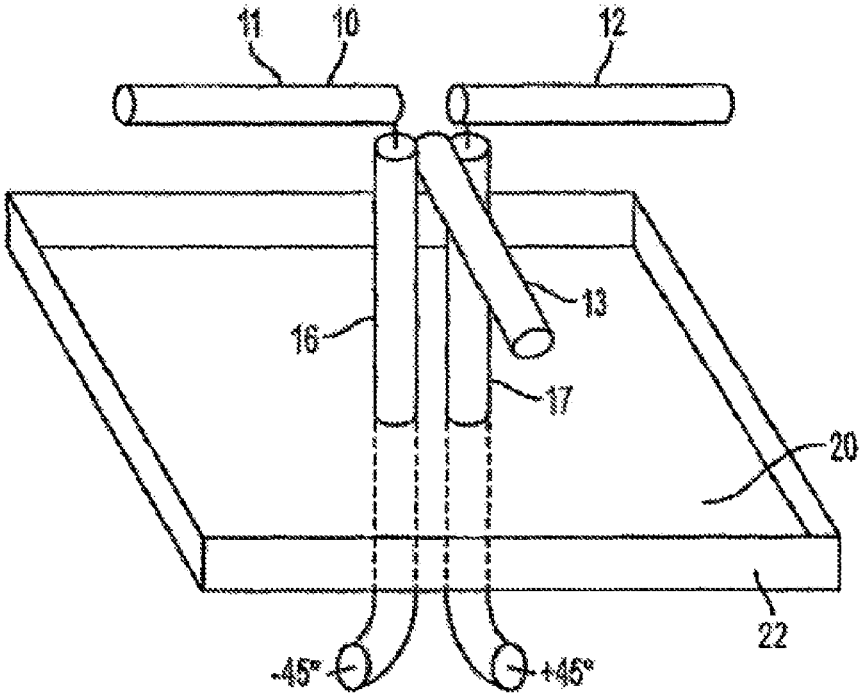
FIG. 10A is a schematic view schematically illustrating a configuration of a tri-pole radiating element in a conventional base station antenna.
Figure 10B:
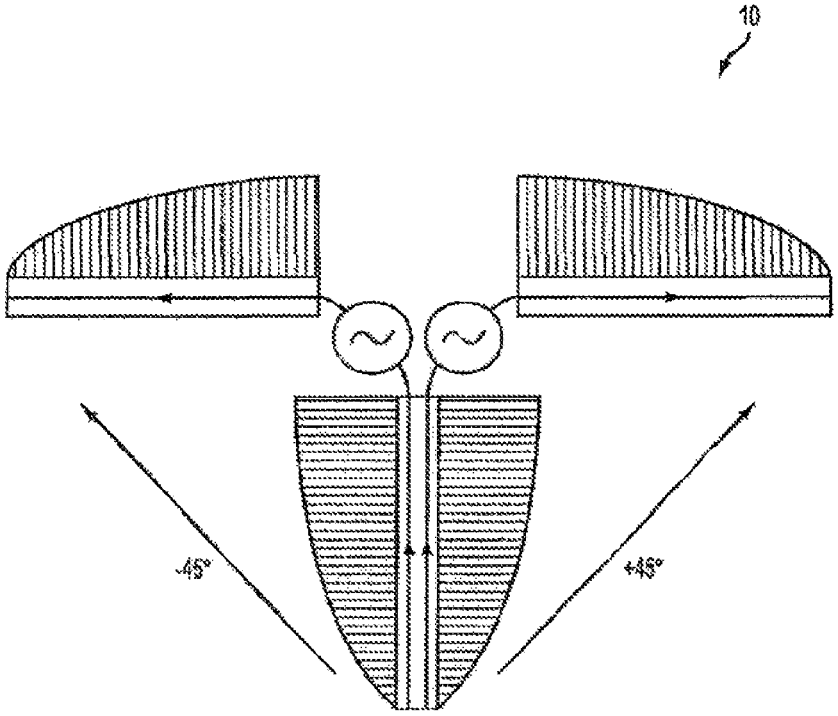
FIG. 10B schematically illustrates an electromagnetic field generated by the tri-pole radiating element in FIG. 10A.

The base station antenna 100 also includes RF ports 151 and 152 for providing signals with two different polarizations, respectively (for example, by receiving signals from the radio 42 shown in FIG. 9). For example, one side arm of each of the tri-pole radiating elements 131, 132 may be coupled to the RF port 151 to receive a signal with +45 degree polarization, and the other side arm may be coupled to the RF port 152 to receive a signal with −45 degree polarization. One dipole arm of each cross dipole radiating element 120 is coupled to the RF port 151 to receive a signal with +45 degree polarization, and the other dipole arm of each cross dipole radiating element 120 is coupled to the RF port 152 to receive a signal with −45 degree polarization. It will be appreciated that any radiating element involved in the present invention (including the cross dipole radiating elements and tri-pole radiating elements) may be coupled to the RF ports in any known manner. It should be noted that, for the sake of brevity, the RF ports are not shown in some drawings, but it will be appreciated that the RF ports also exist in the antennas according to embodiments depicted by these drawings.

The azimuth beamwidths of the antenna beams generated by the linear array that includes the cross dipole radiating elements 120 and the tri-pole radiating elements 131, 132 will depend on a number of things, including the height of the cross dipole radiating element 120 (the dimension extending forward from the reflector, usually about ¼ the wavelength corresponding to the center frequency of the operating frequency band), the structure of the radiating arm, the dimension of the reflector 110 and the like. For example, in one specific implementations, the width of the reflector 110 may be 300 mm and the linear array of cross dipole radiating elements 120 may have a beam width that ranges from 63° to 79° (approximately 71° on average) in the 617-960 MHz frequency band (or 694-960 MHz frequency band). As mentioned above, the linear array is desired to have a beam width of approximately 65°, e.g., 65±5°. In order to obtain a narrower beam width without significantly increasing the width of the antenna (for example, without using two side-by-side linear arrays and without using a significantly wider reflector), a pair of tri-pole radiating elements 130 may be added to the linear array. First, as described above, compared to a cross dipole radiating element having a similar operating frequency band and characteristics, the tri-pole radiating element has a smaller size. Second, a pair of radiating elements arranged side by side (or a pair of columns of radiating elements arranged side by side) may obtain a narrower beam width than a single radiating element (or a single column of radiating elements). Third, as the pair of tri-pole radiating elements 131 and 132 are each oriented such that the arms on the outer side extend in a direction that is substantially parallel to the longitudinal axis 140, each tri-pole radiating element 131 and 132 may be positioned so that its outer side arms are rather close to an edge portion of the reflector 110. Thus, the phase centers of the two tri-pole radiating elements 131 and 132 may be spaced apart from each other at a relatively large distance even when the width of the reflector is narrow. Accordingly, as compared with two cross dipole radiating elements that are placed side by side, the pair of tri-pole radiating elements 130 may render a larger distance in a horizontal direction (the horizontal direction refers to a width direction of the base station antenna) between two radiating elements without increasing the width of the reflector 110, which helps to reduce the azimuth beam widths of the antenna beams generated by the linear array. Therefore, the combined antenna beam of the entire array formed by the linear array of cross dipole radiating elements 120 and the pair of tri-pole radiating elements 130 has a smaller azimuth beam width than the linear array of cross dipole radiating elements 120, so that the base station antenna 100 may obtain a desired narrower beam width, e.g., 65±5°.

In an embodiment, as shown in FIG. 1A, the pair of tri-pole radiating elements 130 is positioned above and/or below (not shown) the linear array along the longitudinal axis. For example, the distance between the pair of tri-pole radiating elements 130 and the nearest cross dipole radiating element 120 may be 0.8 times the wavelength corresponding to the center frequency of the operating frequency band. In an embodiment, as shown in FIG. 1C, the pair of tri-pole radiating elements 130 is positioned between two cross dipole radiating elements 120 in the linear array. In an embodiment, as shown in FIG. 1B, the pair of tri-pole radiating elements 130 is positioned in the middle portion of the linear array along the longitudinal axis. For the entire array formed by the linear array of cross dipole radiating elements 120 and the pair of tri-pole radiating elements 130, typically the sub-components of the RF signal that are fed to the radiating elements in the vicinity of the center of the entire array have higher energy than the sub-components of the RF signals that are fed to the radiating elements in the vicinity of upper or lower end of the entire array in order to shape the antenna beams in the elevation plane. Therefore, the energy of the sub-components of the RF signals that are fed to the pair of tri-pole radiating elements 130 in the embodiment shown in FIG. 1B may be higher than the energy of the sub-components of the RF signals that are fed to the pair of tri-pole radiating elements 130 in the embodiment shown in FIG. 1C, and the energy of the sub-components of the RF signals that are fed to the pair of tri-pole radiating elements 130 in the embodiment shown in FIG. 1C may be higher than the energy of the sub-components of the RF signals that are fed to the pair of tri-pole radiating elements 130 in the embodiment shown in FIG. 1A. It will be appreciated that, the higher the energy of the sub-components of the RF signals that are fed to the pair of tri-pole radiating elements 130 (compared to the energy of the sub-components of the RF signals that are fed to the cross dipole radiating element 120 in the linear array), the greater the influence that the tri-pole radiating elements 131, 132 will have on the combined antenna beam of the entire array (that is, on the narrowing effect on the azimuth beam widths). Therefore, the position of the pair of tri-pole radiating elements 130 in the entire array may be determined according to the performance requirements of the radiation pattern for the base station antenna and the like.

Figure 2A:
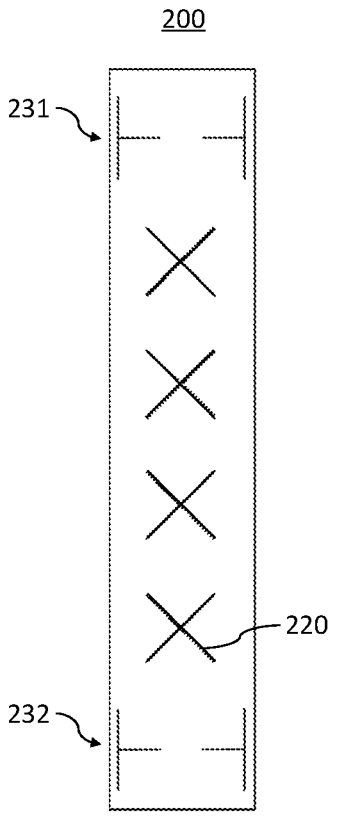
FIGS. 2A and 2B are front views each schematically illustrating a configuration of a base station antenna according to an embodiment of the present invention.
Figure 2B:
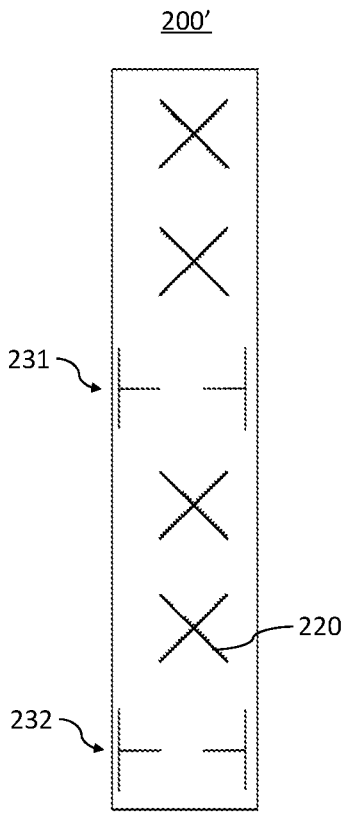

In some embodiments, for example, in the case that one pair of tri-pole radiating elements is not sufficient to meet the requirement for the narrowing effect of the combined antenna beam of the entire array, the base station antenna may include two or more pairs of tri-pole radiating elements. Each of the pairs of tri-pole radiating elements includes, similarly to the foregoing, a pair of tri-pole radiating elements disposed facing each other on both sides of the longitudinal axis. FIGS. 2A and 2B are front views each schematically illustrating a configuration of a base station antenna 200 (or 200') according to an embodiment of the present invention. In an embodiment, as shown in FIG. 2A, two pairs of tri-pole radiating elements 231, 232 are positioned above and below the linear array of cross dipole radiating elements 220 along the longitudinal axis, respectively. In an embodiment, as shown in FIG. 2B, a pair of tri-pole radiating elements 231 is positioned in the middle portion of the linear array of cross dipole radiating elements 220 along the longitudinal axis, and a pair of tri-pole radiating elements 232 is positioned above (not shown) or below the linear array along the longitudinal axis. In an embodiment, although not shown, each of the two pairs of tri-pole radiating elements is positioned between two cross dipole radiating elements in the linear array.

Figure 3A:
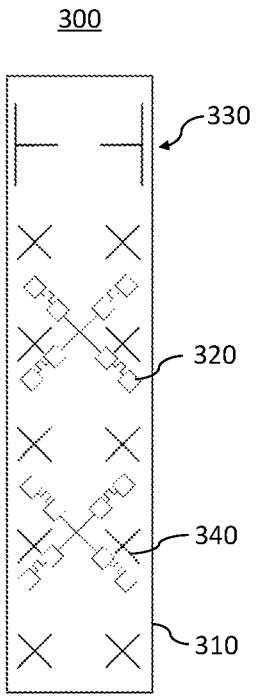
FIGS. 3A and 3B are front views each schematically illustrating a configuration of a base station antenna according to an embodiment of the present invention.
Figure 3B:
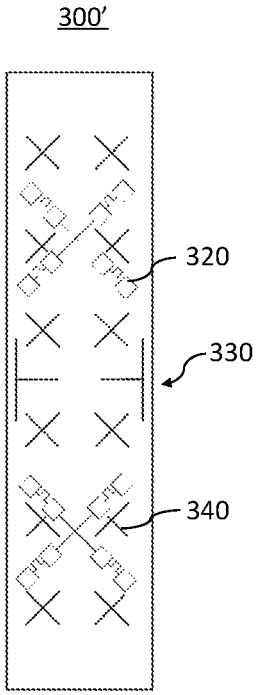

FIGS. 3A and 3B are front views each schematically illustrating a configuration of a base station antenna 300 (or 300') according to an embodiment of the present invention. The base station antenna 300 is a multiband antenna. The base station antenna 300 includes a linear array of cross dipole radiating elements 320 having a lower operating frequency band (for example, at least a portion of the 617-960 MHz frequency band), a pair of tri-pole radiating elements 330 having the lower operating frequency band, an array of cross dipole radiating elements 340 having a higher operating frequency band (for example, at least a portion of 1695-2690 MHz frequency band), and a reflector 310. The cross dipole radiating elements 320, 340 and tri-pole radiating elements in the pair of tri-pole radiating elements 330 extend forwardly from the reflector 310. As the forward extension of the radiating elements from the reflector 310 is matched to the wavelength of the operating frequency band, the forward extension of the cross dipole radiating elements 340 from the reflector 310 is less than the forward extension of either the cross dipole radiating elements 320 or the tri-pole radiating elements from the reflector 310. The pair of tri-pole radiating elements 330 is constructed and oriented in similar ways to those as described above, and will not be repeated here. Although the radiating elements 340 with the higher operating frequency band are cross dipole radiating elements in the drawings, it will be appreciated that other types of radiating elements may be used as the radiating elements with the higher operating frequency band.

Figure 7:
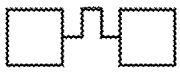
FIG. 7 is a diagram for illustrating a radiating arm of a radiating element with a cloaked feature.

The cross dipole radiating elements 320 in the linear array each include four radiating arms (also referred to as "dipole arms"), and each radiating arm is configured to reduce the current that is excited on this radiating arm (called excitation current in short herein) by electromagnetic radiation of the radiating elements 340, that is, to reduce an excitation current in the higher operating frequency band. Such a feature of the radiating arm is hereinafter referred to as a cloaked feature. In the drawings of the present invention, the diagram shown in FIG. 7 is used to indicate a circuit structure capable of reducing the excitation current. For example, in FIG. 3A, each dipole arm of each cross dipole radiating element 320 is configured to have such a structure. Although the structure shown in FIG. 7 includes two capacitive elements and one inductive element, it will be appreciated that the diagram shown in FIG. 7 is only schematic and does not limit the numbers of the capacitive elements or inductive elements.

As the cross dipole radiating elements 320 have dipole arms that are configured to reduce an excitation current in the higher operating frequency band, the radiation signals of the cross dipole radiating elements 340 having the higher frequency band may not be scattered by the cross dipole radiating elements 320 having the lower frequency band. Hence, the cross dipole radiating elements 320 may be placed near, for example, above the cross dipole radiating elements 340, so that the cross dipole radiating elements 320 are positioned such that at least one arm of at least some of the cross dipole radiating elements 320 partially overlaps the radiator of one or more of the cross dipole radiating elements 340 in a front view of the base station antenna (i.e., in a front view that extends along an axis that is perpendicular to a main surface of the base station antenna). Herein, the main surface of the base station antenna refers to a surface of the reflector for mounting a radiating element, for example, the surface of the reflector 310 that can be seen in FIG. 3A. Although not shown in the drawings, the base station antenna may include a reflector having a plurality of surfaces for mounting radiating elements. In this case, the base station antenna may have multiple main surfaces.

As for the radiating elements in the pair of tri-pole radiating elements 330 that do not have a cloaked feature, the position thereof may be selected to suppress or prevent scattering of the radiation signals of the cross dipole radiating elements 340 having the higher frequency band. In an embodiment, as shown in FIG. 3A, the pair of tri-pole radiating elements 330 is positioned above or below the array of cross dipole radiating elements 340 along the longitudinal axis. In consideration of shaping the antenna beam in the elevation plane, the energy of the sub-components of the RF signal that are fed to the cross dipole radiating elements 340 at the upper and lower ends of the array is relatively low (compared to the energy of the sub-components of the RF signal that are fed to the cross dipole radiating elements 340 at other positions) As such, locating the tri-pole radiating element in the positions in the array that are fed with less energy may reduce the effect of the pair of tri-pole radiating elements 330 on the radiation of the entire array of cross dipole radiating elements 340. In addition, arranging the tri-pole radiating element pair 330 far from the radiating elements 340 array may also reduce the influence on the radiation of the radiating elements 340. For example, in the embodiment shown in FIG. 3A, the radiating elements 320 having the cloaked feature are closer to the radiating elements 340, and the radiating elements 330 having no cloaked feature are positioned farther from the radiating elements 340, so that when the electromagnetic radiation emitted by the radiating elements 340 reaches the vicinity of the tri-pol radiating elements 330, the intensity of the radiation signal is relatively small so as to reduce the influence on the radiation of the radiating elements 340. In an embodiment, as shown in FIG. 3B, the pair of tri-pole radiating elements 330 is positioned such that two side arms and a central arm of each tri-pole radiating element do not overlap the radiator of the radiating elements 340 in a front view of the base station antenna. Thus, the radiating arms of the tri-pole radiating elements 331, 332 make space for the radiation aperture of the radiating elements 340, which may reduce the effect on the radiation of the radiating elements 340. In the embodiments shown in FIGS. 3A and 3B, the dipole arms of the crossed dipole radiating elements 340 having the higher operating frequency band extend in directions that are slant ±45 degrees with respect to the longitudinal axis, and the radiating arms of each tri-pole radiating element 331, 332 in the radiating element pair 330 extend parallel and vertical to the longitudinal axis, which makes it easy to position the radiating arms of the tri-pole radiating elements 331, 332 between two adjacent columns or adjacent rows of the crossed dipole radiating elements 340 in the front view so as to make space for the radiation aperture of the crossed dipole radiating element s340, as shown in FIGS. 3B and 5C. Accordingly, the impact on the radiation of the radiating elements 340 may be reduced.

Figure 4:
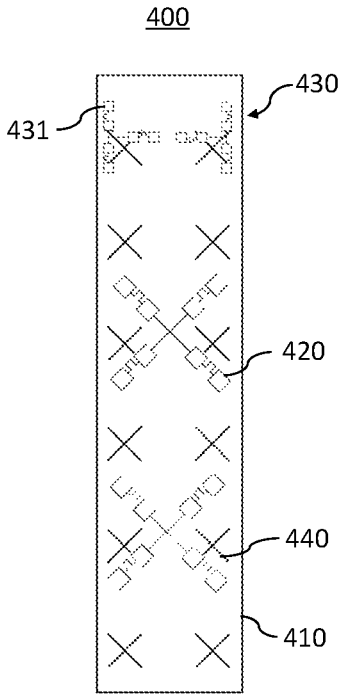
FIG. 4 is a front view schematically illustrating a configuration of a base station antenna according to an embodiment of the present invention.
Figure 8A:
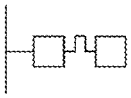
FIGS. 8A and 8B are front views each schematically illustrating a configuration of a tri-pole radiating element in the base station antenna according to an embodiment of the present invention.
Figure 8B:
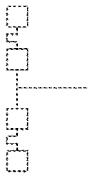

FIG. 4 schematically illustrates a configuration of a base station antenna 400 according to an embodiment of the present invention. Some components 410, 420, and 440 of the base station antenna 400 are similar to the components 310, 320, and 340 of the base station antenna shown in FIG. 3A, respectively, and will not be repeated here. Each tri-pole radiating element in the pair of tri-pole radiating elements 430 has radiating arms that are configured to be cloaked so as to reduce a current excited onto the radiating arms by electromagnetic radiation of the radiating element 440, that is, to reduce an excitation current in the higher operating frequency band. Thus, the pair of tri-pole radiating elements 430 may be positioned such that the radiating arms capable of reducing the excitation current in the higher operating frequency band at least partially overlap radiators of the radiating elements 440 in the front view. Although the radiating arms of each tri-pole radiating element in the pair of tri-pole radiating elements 430 are all configured to be cloaked in the drawings, it will be appreciated that the desired effect of the present invention may be achieved so far as at least one radiating arm of at least one tri-pole radiating element is such configured. It should be noted that although in the drawings of the present invention, the diagram as denoted by 431 in FIG. 4 is used to indicate the tri-pole radiating element with cloaked features in the higher operating frequency band, it will be appreciated that this diagram is only schematic, and it is not limited that each radiating arm of the tri-pole radiating element is constructed to reduce the excitation current in the higher operating frequency band. For example, the diagram as denoted by 431 may also be used to refer to a tri-pole radiating element as shown in FIG. 8A or 8B.

In an embodiment, the radiating arm of the tri-pole radiating element configured to reduce the excitation current in the higher operating frequency band includes a resonant circuit. The resonant circuit includes one or more capacitive elements coupled in series by one or more inductive elements, and the resonant circuit is configured such that a current is at least partially attenuated when passing through the radiating arm in the higher operating frequency band and passes through in the lower operating frequency band, so as to enable the radiating arm to reduce an excitation current in the higher operating frequency band. For example, the resonant circuit may be configured to resonate at around 800 MHz, allow a current to pass through the radiating arm in 617-960 MHz frequency band, and significantly attenuate a current on the radiating arm in at least a portion of 1695-2690 MHz frequency band, so that the radiating arm of the tri-pole radiating element is configured to reduce the current that is excited onto this radiating arm by electromagnetic radiation of the radiating elements 440. In an embodiment, the radiating arm of each tri-pole radiating element includes at least one inductive element configured to have a higher impedance in the higher operating frequency band and a lower impedance in the lower operating frequency band, so as to capable of reducing excitation currents in the higher operating frequency band.

Figure 5A:
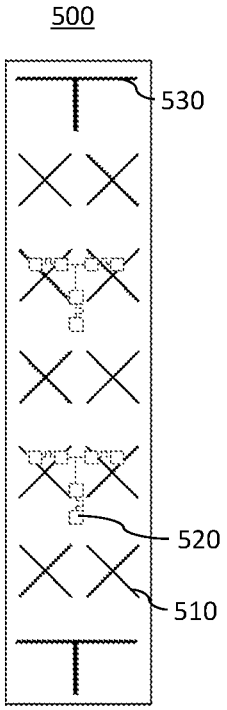
FIGS. 5A-5C are front views each schematically illustrating a configuration of a base station antenna according to an embodiment of the present invention.
Figure 5B:
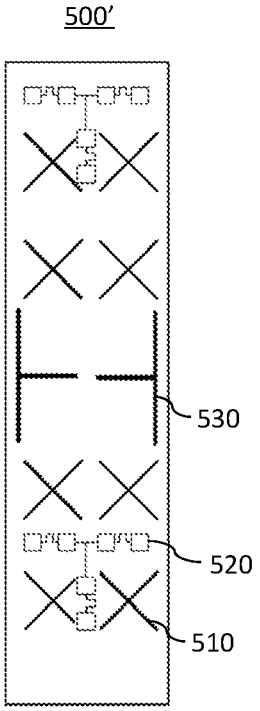
Figure 5C:
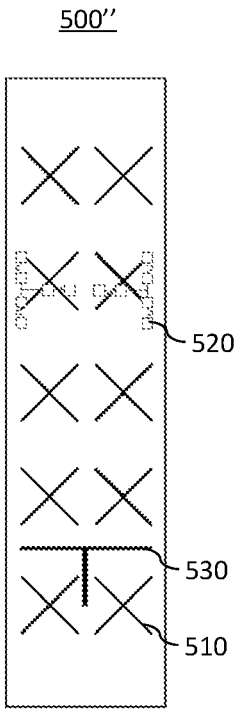

FIGS. 5A-5C are front views each schematically illustrating a configuration of a multiband base station antenna 500 (or 500', 500") according to an embodiment of the present invention. The multiband base station antenna 500 includes a first array of radiating elements 510 having a higher operating frequency band, and a second array of tri-pole radiating elements 520, 530 having a lower operating frequency band. At least one radiating arm of each tri-pole radiating element 520 is configured to be cloaked so as to reduce a current that is excited onto this radiating arm by electromagnetic radiation of the radiating element 510, that is, to reduce excitation currents in the higher operating frequency band, thereby reducing the effect of the radiating element 520 on the electromagnetic radiation of the radiating element 510. The at least one radiating arm may be constructed as described above with reference to FIG. 4, in which the at least one radiating arm may be a side arm extending in a direction substantially parallel to the longitudinal axis of the base station antenna, or may be a central arm extending in a direction substantially perpendicular to the longitudinal axis of the base station antenna. The tri-pole radiating element 520 may be positioned such that at least one radiating arm thereof partially overlaps the radiator of the radiating element 510 in a front view of the base station antenna. The radiating arm of the tri-pole radiating element 530 may have a different configuration than the tri-pole radiating element 520, that is, the tri-pole radiating element 530 does not have a radiating arm configured to reduce excitation currents in the higher operating frequency band. In an embodiment, as shown in FIG. 5A, the tri-pole radiating element 530 is positioned above and/or below the first array along the longitudinal axis. In this embodiment, the tri-pole radiating elements 520, 530 are arranged in the longitudinal direction to form a second array. In an embodiment, as shown in FIGS. 5B and 5C, the tri-pole radiating element 530 is positioned such that each radiating arm of the tri-pole radiating element 530 does not overlap the radiator of the radiating element 510 in a front view of the base station antenna. In the embodiment shown in FIG. 5B, two tri-pole radiating elements 530 are disposed facing each other to form a pair of tri-pole radiating elements which, together with the tri-pole radiating elements 520, is disposed in the longitudinal direction to form a second array. In the embodiment shown in FIG. 5C, two tri-pole radiating elements 520 are disposed facing each other to form a pair of tri-pole radiating elements which, together with the tri-pole radiating elements 530, is disposed in the longitudinal direction to form a second array.

Figure 6:
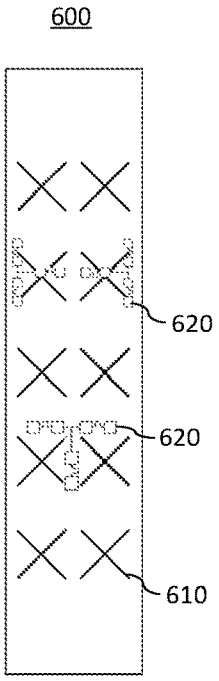
FIG. 6 is a front view schematically illustrating a configuration of a base station antenna according to an embodiment of the present invention.

FIG. 6 is a front view schematically illustrating a configuration of a multiband base station antenna 600 according to an embodiment of the present invention. The multiband base station antenna 600 includes a first array of radiating elements 610 having a higher operating frequency band, and a second array of tri-pole radiating elements 620 having a lower operating frequency band. Two tri-pole radiating elements 620 are disposed facing each other to form a pair of tri-pole radiating element which, together with another tri-pole radiating element 620, are disposed in the longitudinal direction to form a second array. At least one radiating arm of each tri-pole radiating element 620 is configured to reduce the current excited onto this radiating arm by the electromagnetic radiation of the radiating element 610, that is, to reduce an excitation current in the higher operating frequency band. The at least one radiating arm may be constructed as described above with reference to FIG. 4, in which the at least one radiating arm may be an arm that extends in a direction substantially parallel to the longitudinal axis of the base station antenna, or may be an arm that extends in a direction substantially perpendicular to the longitudinal axis. The tri-pole radiating elements 620 may be positioned such that the at least one radiating arm at least partially overlaps the radiator of the radiating element 610 in the front view.

Figure 11A:
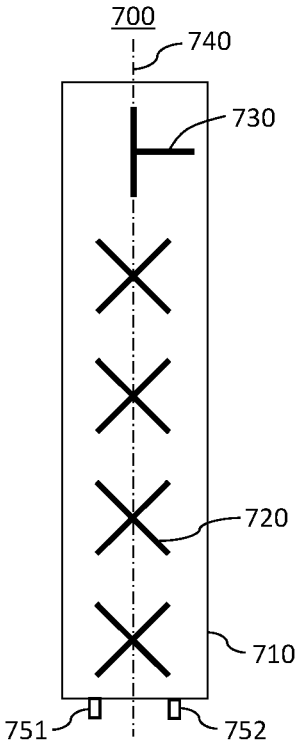
FIGS. 11A and 11B are front views each schematically illustrating a configuration of a base station antenna according to an embodiment of the present invention.
Figure 11B:
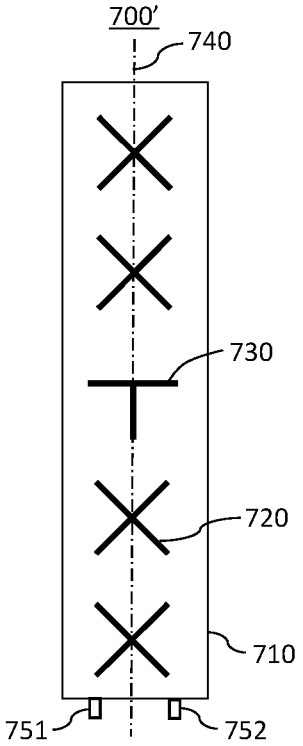

FIGS. 11A and 11B are front views each schematically illustrating a configuration of a base station antenna 700 (or 700') according to an embodiment of the present invention. The base station antenna 700 includes an array formed by a plurality of cross dipole radiating elements 720 and one tri-pole radiating element 730 that are arranged in a column generally along a longitudinal axis 740. Each of the radiating elements extends forward from the reflector 710. The base station antenna 700 further includes RF ports 751 and 752 for providing signals with +45 and −45 degree polarizations, respectively. Each cross dipole radiating element 720 includes a slant +45 degree dipole arm and a slant −45 degree dipole arm, both of which are coupled to the respective RF ports 751 and 752. The tri-pole radiating element 730 in the embodiment shown in FIG. 11A includes two vertically-extending dipole arms and one horizontally-extending dipole arm, and the two vertically-extending dipole arms are coupled to the RF ports 751 and 752, respectively. The tri-pole radiating element 730 in the embodiment shown in FIG. 11B includes one vertically-extending dipole arm and two horizontally-extending dipole arms, and the two horizontally-extending dipole arms are coupled to the RF ports 751 and 752, respectively. The azimuth half-power beam width of the tri-pole radiating element 730 is generally larger than the azimuth half-power beam width of the cross dipole radiating element 720, but such configuration of the array in the base station antenna 700 is useful. First, the tri-pole radiating element has one less dipole arm than the cross dipole radiating element, which makes it possible to reduce costs and simplify feeding. Second, the tri-pole radiating element has a small size, for example, the space on the left side of the tri-pole radiating element 730 in FIG. 11A is saved, where elements (for example, a radiating element operating in a higher frequency band) of the antenna may be placed as required, to facilitate compact design of the antenna. Third, the tri-pole radiating element and the cross dipole radiating element may make up other's shortcomings in the radiation pattern so as to improve the pattern of the entire array.

Figure 12A:
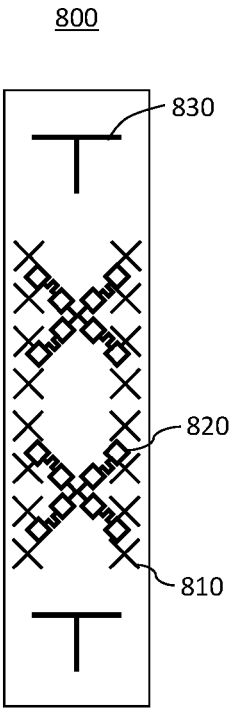
FIGS. 12A and 12B are front views each schematically illustrating a configuration of a base station antenna according to an embodiment of the present invention.
Figure 12B:
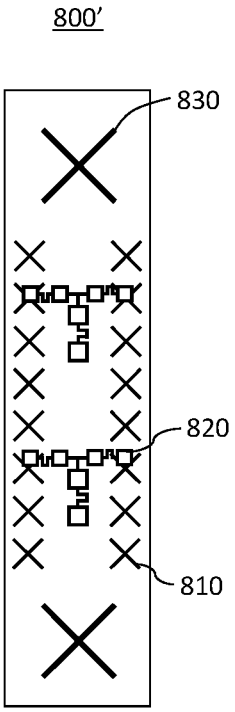

FIGS. 12A and 12B are front views each schematically illustrating a configuration of a base station antenna 800 (or 800') according to an embodiment of the present invention. The base station antenna 800 includes a first array of radiating elements 820, 830 configured to operate in a lower frequency band, and a second array of radiating elements 810 configured to operate in a higher frequency band. The radiating elements 820 have the circuit structure as shown in FIG. 7 that is capable of reducing an excitation current, and the radiating elements 830 are radiating elements not having the circuit structure as shown in FIG. 7. At least one radiating element 810 in the second array is positioned close to the radiating elements 820 and away from the radiating elements 830. In the embodiment shown in FIG. 12A, the radiating elements 820 are cross dipole radiating elements, and the radiating elements 830 are tri-pole radiating elements. In the embodiment shown in FIG. 12B, the radiating elements 830 are cross dipole radiating elements, and the radiating elements 820 are tri-pole radiating elements. As described above, the base station antenna 800 may further include two RF ports, and each of the radiating elements 820, 830 is coupled to the both RF ports. It will be appreciated that the first array may include a plurality of linear arrays extending in the longitudinal direction, wherein any of the linear arrays may include only either of the radiating elements 820 and 830, or both of the radiating elements 820 and 830 as shown in FIGS. 12A and 12B.

In the embodiments shown above, the arrays of radiating elements having a lower operating frequency are shown as only one linear array arranged in the longitudinal direction. It will be appreciated that the base station antenna according to other embodiments of the present invention may include multiple linear arrays positioned horizontally and/or vertically adjacent one another, and at least one of the multiple linear arrays has the configuration as described in the above embodiments.

Figure 13A:
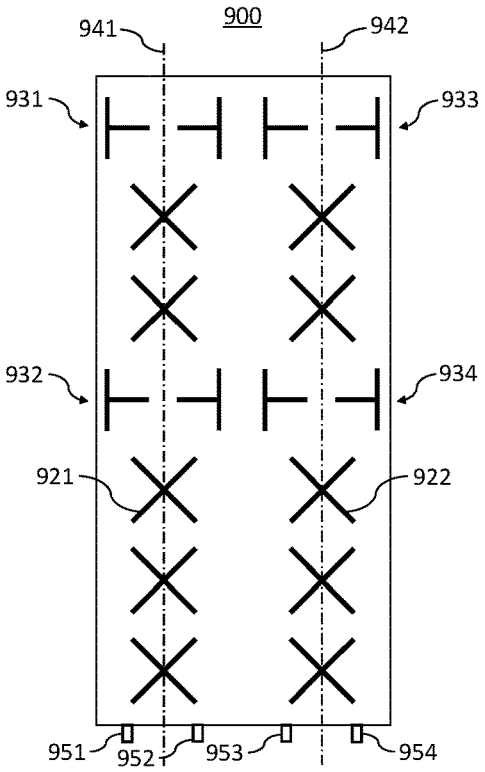
FIGS. 13A and 13B are front views each schematically illustrating a configuration of a base station antenna according to an embodiment of the present invention.
Figure 13B:
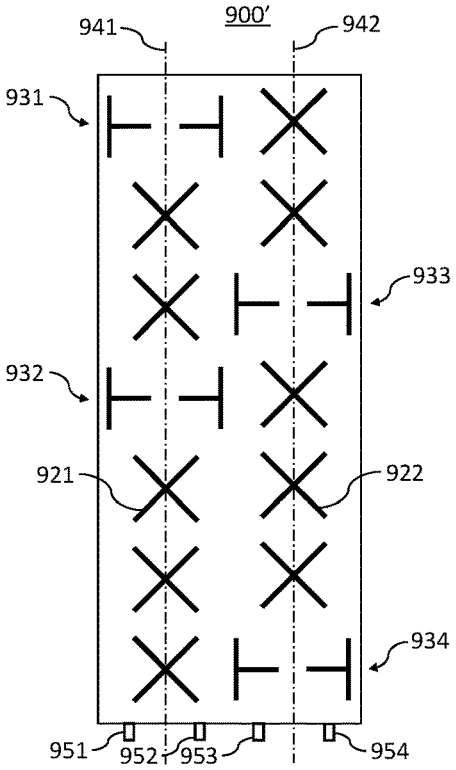

FIGS. 13A and 13B are front views each schematically illustrating a configuration of a base station antenna 900 (or 900') according to an embodiment of the present invention. The base station antenna 900 includes two linear arrays each of which is similar to those in FIGS. 2A and 2B, wherein a first and a second linear array are positioned adjacent each other in the horizontal direction. The first linear array is formed by cross dipole radiating elements 921 and pairs of tri-pole radiating element 931 and 932 that are arranged in a column along the longitudinal axis 941. The crossed dipole radiating elements 921 and the tri-pole radiating element pairs 931, 932 operate in the first frequency band. The second linear array is formed by cross dipole radiating elements 922 and pairs of tri-pole radiating element 933 and 934 that are arranged in a column along the longitudinal axis 942. The crossed dipole radiating elements 922 and the tri-pole radiating element pairs 933, 934 operate in the second frequency band. The first frequency band and the second frequency band are at least partially overlapped. The base station antenna 900 further includes RF ports 951 to 954, wherein each cross dipole radiating element 921 and each tri-pole radiating element in the pairs of tri-pole radiating elements 931, 932 in the first linear array are coupled to the RF ports 951 and 952 respectively, and each cross dipole radiating element 922 and each tri-pole radiating element in the pairs of tri-pole radiating elements 933, 934 in the second linear array are coupled to the RF ports 953 and 954 respectively. The base station antenna 900 may be used in, for example, a communication system using MIMO technology to improve channel capacity. Where the array is configured to operate in more frequency bands, the antenna may also include more pairs of RF ports. For example, in a case where the first linear array is configured to further operate in a third frequency band, the base station antenna 900 may further include another pair of RF ports to provide signals in the third frequency band. Each cross dipole radiating element 921 and each tri-pole radiating element of the pairs 931, 932 is respectively coupled to the pair of RF ports 951 and 952, and to the another RF ports. In an embodiment, as shown in FIG. 13A, the longitudinal positions of the pairs of tri-pole radiating elements in the first linear array are the same as those in the second linear array. For example, the pairs of tri-pole radiating elements are both positioned in the first and fourth rows. This configuration of the arrays may be used in the case where the antenna has a sufficient width. In another embodiment, as shown in FIG. 13B, the longitudinal positions of the pairs of tri-pole radiating elements are different in the first and second linear arrays. For example, the pairs of tri-pole radiating elements are positioned in the first and fourth rows in the first linear array and are positioned in the third and seventh rows in the second linear array. This configuration of the arrays may be used to reduce the antenna width.

Figure 14A:
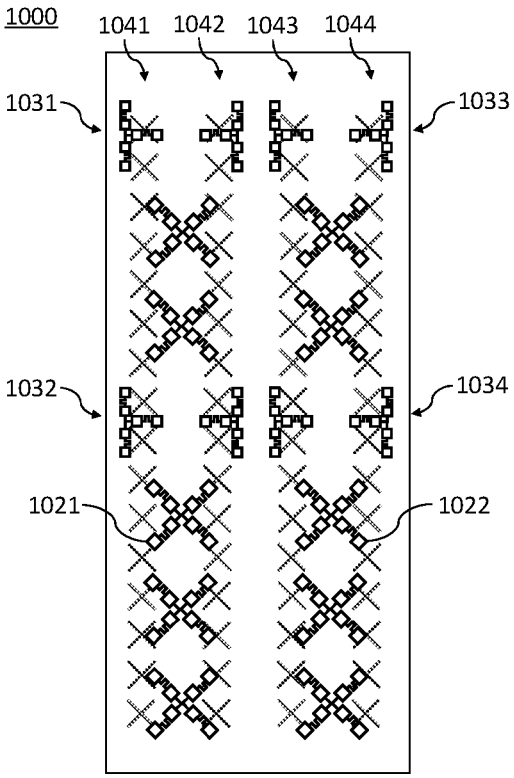
FIGS. 14A and 14B are front views each schematically illustrating a configuration of a base station antenna according to an embodiment of the present invention.
Figure 14B:
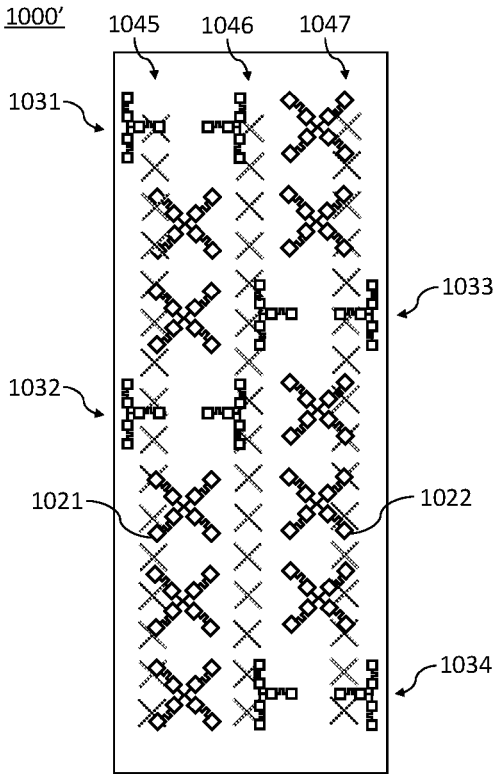

FIGS. 14A and 14B are front views each schematically illustrating a configuration of a base station antenna 1000 (or 1000') according to an embodiment of the present invention. Compared to the base station antenna 900, the base station antenna 1000 further includes an array of radiating elements (high-frequency array) that operate in a higher frequency band. In the antenna 1000, the radiating elements (forming a low-frequency array) that operate in a lower frequency band have cloaked features (similar to the above and will not be described here). The low-frequency array includes first and second linear arrays of radiating elements 1021, 1022, and radiating element pairs 1031 to 1034, which have similar configurations to the first and second linear arrays in the base station antenna 900, and are no longer explained here. In an embodiment, when the space between the first and second linear arrays is relatively large, more than one column of radiating elements that operate in the higher frequency band may be arranged between the first and second linear arrays. As shown in FIG. 14A, an array of radiating elements that operate in the higher frequency band includes first to fourth columns 1041 to 1044, of which two columns 1042 and 1043 are arranged between the first and second linear arrays, and two columns 1041 and 1044 are arranged along the side edges of the antenna. It will be appreciated that in some embodiments, even if the space between the first and second linear arrays is sufficient, only one column or no column operating in the higher frequency band may be arranged between the first and second linear arrays. In an embodiment, when the space between the first and second linear arrays is small, only one column of radiating elements that operate in a higher frequency band may be arranged between the first and second linear arrays. As shown in FIG. 14B, the array of radiating elements that operate in the higher frequency band includes first to third columns 1045 to 1047, of which one column 1046 is arranged between the first and second linear arrays, and columns 1045 and 1047 are arranged along the respective side edges of the antenna. It will be appreciated that in some embodiments, even if the space between the first and second linear arrays is small, more than one column or no column operating in the higher frequency band may be arranged between the first and second linear arrays. It will be appreciated that in some embodiments, only one column, more than one column, or no column operating in the higher frequency band may be arranged on either sides of the low frequency arrays. For simplicity, no RF ports are shown in FIGS. 14A and 14B, but it will be appreciated that in a communication system using MIMO technology, any column of radiating elements in the base station antenna 1000 may be coupled to one or more pairs of RF ports.

Although some specific embodiments of the present invention have been described in detail with examples, it should be understood by a person skilled in the art that the above examples are only intended to be illustrative but not to limit the scope of the present invention. The embodiments disclosed herein can be combined arbitrarily with each other, without departing from the scope and spirit of the present invention. It should be understood by a person skilled in the art that the above embodiments can be modified without departing from the scope and spirit of the present invention. The scope of the present invention is defined by the attached claims.

That which is claimed is:

1. A base station antenna, comprising a first array configured to emit electromagnetic radiation in a first frequency band so as to form a first antenna beam, the first array including a first column of radiating elements that are arranged substantially along a first longitudinal axis of the base station antenna, the first column including a first radiating element and a pair of second radiating elements, wherein:

the first radiating element is a cross dipole radiating element; and the pair of second radiating elements includes a pair of second radiating elements that are disposed facing each other on both sides of the first longitudinal axis, wherein each of the second radiating elements includes first and second radiating arms that extend respectively in opposite directions substantially along the first longitudinal axis, and a third radiating arm that extends toward the first longitudinal axis substantially perpendicular to the first and second radiating arms.

2. The base station antenna according to claim 1, wherein the pair of second radiating elements is positioned at an end portion of the first array along the first longitudinal axis.

3. The base station antenna according to claim 1, wherein the first column includes at least two first radiating elements, and the pair of second radiating elements is positioned between the two first radiating elements.

4. The base station antenna according to claim 1, further comprising a second array of third radiating elements that are configured to operate in a second frequency band, at least part of frequencies in the second frequency band being higher than frequencies in the first frequency band, wherein at least one dipole arm of the first radiating element is configured to at least partially attenuate a current in the second frequency band.

5. The base station antenna according to claim 4, wherein the pair of second radiating elements is positioned above or below the second array along the first longitudinal axis.

6. The base station antenna according to claim 4, wherein the pair of second radiating elements is positioned such that the first to third radiating arms of each second radiating element do not overlap the third radiating element in a front view of the base station antenna.

7. The base station antenna according to claim 1, further comprising a second array of third radiating elements that are configured to operate in a second frequency band, at least part of the frequencies in the second frequency band being higher than frequencies in the first frequency band, wherein at least one radiating arm of at least one of the second radiating elements is configured to at least partially attenuate a current in the second frequency band.

8. The base station antenna according to claim 7, wherein the pair of second radiating elements is positioned such that the at least one radiating arm at least partially overlaps the third radiating element in a front view of the base station antenna.

9. The base station antenna according to claim 1, further comprising a second array that is configured to emit electromagnetic radiation in a third frequency band so as to form a second antenna beam, the second array includes a second column of radiating elements that are arranged substantially along a second longitudinal axis of the base station antenna, the second column including a fourth radiating element and a pair of fifth radiating elements, wherein the fourth radiating element is a cross dipole radiating element; and the pair of fifth radiating elements includes a pair of fifth radiating elements that are disposed facing each other on both sides of the second longitudinal axis, wherein each of the fifth radiating elements includes fourth and fifth radiating arms that extend respectively in opposite directions substantially along the second longitudinal axis, and a sixth radiating arm that extends toward the second longitudinal axis substantially perpendicular to the fourth and fifth radiating arms.

10. The base station antenna according to claim 9, wherein the first column and the second column are adjacent each other, and the pairs of second radiating elements and the pairs of fifth radiating elements are positioned at different longitudinal positions.

11. A multiband base station antenna, comprising:

a first array including a first radiating element that is configured to operate in a higher frequency band;

a second array including a tri-pole radiating element that is configured to operate in a lower frequency band, the tri-pole radiating element including first to third radiating arms that extend substantially parallel to a main surface of the base station antenna, wherein the radiating arms are each oriented such that a substantially right angle is formed either between extension directions of the first and second radiating arms or between extension directions of the second and third radiating arms, and at least one of the first to third radiating arms extends substantially in a direction that is parallel to a longitudinal axis of the base station antenna; and a third array including a cross dipole radiating element that is configured to operate in the lower frequency band, wherein at least one dipole arm of the cross dipole radiating element is configured to reduce a current that is excited in the at least one dipole arm in the higher frequency band.

12. The base station antenna according to claim 11, wherein the tri-pole radiating element is positioned above or below the first array along the longitudinal axis.

13. The base station antenna according to claim 11, wherein the tri-pole radiating element is positioned such that the first to third radiating arms do not overlap the first radiating element in a front view of the base station antenna.

14. The base station antenna according to claim 11, wherein at least one of the first to third radiating arms is configured to reduce a current that is excited in the at least one radiating arm in the higher frequency band.

15. The base station antenna according to claim 14, wherein the at least one radiating arm includes at least one inductive element that is configured to have a higher impedance in the higher frequency band and have a lower impedance in the lower frequency band.

16. A base station antenna, comprising:

a first radio frequency ("RF") port;

a second RF port;

a vertically-extending array of radiating elements, wherein each of the radiating elements in the array is coupled to the first RF port and to the second RF port, the array including at least one slant ±45° cross-dipole radiating element and at least one radiating element having either a vertically-extending dipole arm or a horizontally-extending dipole arm.

17. The base station antenna of claim 16, wherein the at least one radiating element having either a vertically-extending dipole arm or a horizontally-extending dipole arm includes both a vertically-extending dipole arm and a horizontally-extending dipole arm.

18. The base station antenna of claim 16, wherein the at least one radiating element having either a vertically-extending dipole arm or a horizontally-extending dipole arm comprises at least one pair of tri-pole radiating elements that each include first and second vertically-extending dipole arms and a horizontally-extending dipole arm.

19. The base station antenna of claim 16, wherein the base station antenna further includes at least one additional vertically-extending array of radiating elements, wherein the at least one additional vertically-extending array of radiating elements is positioned adjacent the at least one cross-dipole radiating element and is spaced apart from the least one radiating element having either a vertically-extending dipole arm or a horizontally-extending dipole arm.

20. The base station antenna of claim 16, wherein an azimuth half power beamwidth of the at least one radiating element having either a vertically-extending dipole arm or a horizontally-extending dipole arm is greater than an azimuth beamwidth of the at least one cross-dipole radiating element.

* * * * *